US007997516B2

(12) United States Patent
Raaz et al.

(10) Patent No.: US 7,997,516 B2
(45) Date of Patent: Aug. 16, 2011

(54) MULTIPLE ROLL CRUSHER

(75) Inventors: Viktor Raaz, Bochum (DE); Detlef Papajewski, Bochum (DE)

(73) Assignee: Thyssenkrupp Fördertechnik GmbH, Essen (DE)

( * ) Notice: Subject to any disclaimer, the term of this patent is extended or adjusted under 35 U.S.C. 154(b) by 241 days.

(21) Appl. No.: 12/162,813

(22) PCT Filed: Jan. 11, 2007

(86) PCT No.: PCT/EP2007/000188

§ 371 (c)(1),
(2), (4) Date: Jul. 31, 2008

(87) PCT Pub. No.: WO2007/090495

PCT Pub. Date: Aug. 16, 2007

(65) Prior Publication Data

US 2009/0020637 A1 Jan. 22, 2009

(30) Foreign Application Priority Data

Feb. 3, 2006 (DE) ..... 10 2006 005 017

(51) Int. Cl.
*B02C 18/16* (2006.01)

(52) U.S. Cl. ..... 241/143; 241/235

(58) Field of Classification Search ..... 241/235, 241/236, 243, 158, 159, 143
See application file for complete search history.

(56) References Cited

U.S. PATENT DOCUMENTS

| | | | | |
|---|---|---|---|---|
| 183,114 | A * | 10/1876 | Blake | 241/135 |
| 256,678 | A * | 4/1882 | Hause | 241/111 |
| 3,066,876 | A | 12/1962 | Verdier | |
| 5,547,136 | A | 8/1996 | Steffens et al. | |
| 5,595,350 | A | 1/1997 | Massaro, Jr. et al. | |

FOREIGN PATENT DOCUMENTS

| | | | |
|---|---|---|---|
| DE | 3430087 | * | 2/1986 |
| DE | 199 04 867 A1 | | 8/2000 |
| JP | 2004-174393 | | 6/2004 |
| WO | WO 88/01201 | * | 2/1988 |
| WO | WO 94/21381 | | 9/1994 |
| WO | WO 2005/046874 | | 5/2005 |

* cited by examiner

*Primary Examiner* — Mark Rosenbaum
(74) *Attorney, Agent, or Firm* — McGlew and Tuttle, P.C.

(57) ABSTRACT

A multiple roll crusher is provided for crushing of mineral material, more particularly of coal or oil sand. The multiple roll crusher includes at least three crusher rolls (1, 2, 5 1', 2'), the rotation axes (R) of which lie in parallel to each other and horizontal or roughly horizontal. All directly neighboring crusher rolls (1, 2, 1', 2') have opposite directions of rotation. A connecting line (V) of the rotation axes (R) has at least one kink.

6 Claims, 9 Drawing Sheets

MULTIPLE ROLL CRUSHER

CROSS REFERENCE TO RELATED APPLICATIONS

This application is a United States National Phase application of International Application PCT/EP2007/000188 and claims the benefit of priority under 35 U.S.C. §119 of German Patent Application 102006005017.7 filed Feb. 3, 2006, the entire contents of which are incorporated herein by reference.

FIELD OF THE INVENTION

The invention relates to a multiple roll crusher for crushing of mineral material, more particularly of coal or oil sand.

BACKGROUND OF THE INVENTION

Multiple roll crushers of this kind particularly serve for crushing of mineral material to be crushed, more particularly for coal, ore, rock, natural stone, bauxite, marl, clay, oil sand or similar materials. These crushers are designed to crush the material arriving with a grain size of up to approx. 150 mm down to a grain size of usually <50 mm. Especially on crushing of coal, it is important that it is not or only a little compacted during the crushing procedure and that its inner structure is mainly maintained.

State of the art in technology according to DE 199 04 867 A1 is a device for crushing of mineral material with two crushing rolls, with the crushing procedure being executed between the crushing rolls and the walls of the crusher casing lying opposite to these rolls and provided with crushing devices. No crushing procedure runs between the two crushing walls with rotate in opposite direction.

Known from U.S. Pat. No. 5,547,136 is a mill in which the crushing procedure is executed between two rolls with cutting elements arranged at the circumference on helical lines. Underneath of the working gap, a fixed anvil extending in the longitudinal direction of the roll is arranged, with arched sieves being fastened to it on both sides adapted to the outer shape of the crushing rolls. Material that does not fall through the holes of the sieves is transported above these sieves back into the charge space. This mill mainly serves for fine crushing and/or grinding of waste material down to comparably small grain sizes.

An arrangement for crushing and cooling of an already relatively fine grain size material leaving from a calcining kiln is described in WO 94/21 381 AI, wherein the crusher has several roller-type crusher elements arranged side by side and at one level on a flying support. The rotational direction of the crusher rolls alternates from one roll to the other. The crusher rolls arranged on the same level fill the entire width of the dumping area of the inflow shaft, with one working gap each being left free between the crusher rolls, the size of said gap being determined by the desired grain size of the material to be calcined.

Known from U.S. Pat. No. 5,595,350 A is another roll-type crusher located at the end of a cooling facility, with four crusher rolls being arranged side by side, the first three of which, viewed from the feed side, rotate clockwise and wherein the fourth turns anti-clockwise opposite thereto. The material coming from the feed side and which has not yet fallen through the intermediate spaces between the first rolls is thus crushed in the gap between the third and the fourth roll. These four rolls are loaded differently during this process.

SUMMARY OF THE INVENTION

Now, therefore, it is the subject and task of the present invention to propose a multiple roll crusher of the generic species, in which the material is mainly crushed without compaction and preferably by way of shearing processes and in which a high throughput rate is achieved in the smallest possible crusher space and with the least possible mechanical wear or tear.

With the inventive multiple roll crusher comprised of at least three crushing rolls in one crusher space it is envisaged that all directly neighboring crusher rolls have opposite directions of rotations and that the connecting line (V) of the rotation axes (R) has at least one kink. This kink provides the result that the total width (B) of the crusher space wherein the crusher rolls are arranged in parallel side by side can either be reduced while maintaining the distance of the rotation axes (R) or that possibly more crusher rolls can be accommodated while maintaining the width of the crusher space, thus enhancing the throughput rate per overall width of the crusher space. The arrangement and size of the kink are so chosen that wear and tear of crushing tools and crushers are minimized by way of providing for the least possible deflection of the material to be crushed on its way, or material transport direction, from the feed opening of the crusher to the passage through the working gap.

In principle, the crusher rolls can be utilized with a smooth surface, i.e. non-teethed. But it has also turned out to be favorable to arrange crushing or cutting teeth of equal or non-equal teeth height and/or teeth shape in equal or non-equal spreading at the circumference of the crusher rolls and to let these co-act with cutting elements which are arranged at the tip and/or side in the upper area at an anvil ledge that is preferably supported height-adjustable and/or resilient in vertical direction. The cutting elements can preferably be arranged at the anvil ledge at ledges extending over the entire length of the crusher rolls, with the cutting teeth being able to engage in teeth gaps of the ledge at the crusher rolls. The inventive multiple roll crusher, however, may also be constructed without an anvil ledge and/or without a cutting element. With the inventive multiple roll crusher, all the material is crushed between the two crusher rolls or between a crusher roll and wall-side crushing teeth as it passes through the working gap, with the adjustable and/or resilient bearing support of the anvil ledge preventing any interference due to large-size or hard lumps of material. To adjust the grain size of the product, the working gap can also be adjusted by varying the axis distance of the crusher rolls and/or by modifying the distance to the anvil ledge. Corresponding to the required grain size of the product, the cutting teeth of two neighboring crusher rolls at the roll circumference can be arranged at staggered angles.

According to the present invention, one working gap and one empty no-load gap alternate each over the entire width of the crusher space because of the alternating direction of rotation of the crusher rolls. The material is conveyed through the working gap mainly from the top downward or obliquely downward and thus crushed. In the area of the empty gap, the crushing and cutting teeth at the circumference of the crushing rolls move upward and/or obliquely upward, so that a crushing of the material will not occur there. The gap width of the empty gap is smaller than or equal to the gap width of the working gap. In the area of the empty gap, in particular, the cutting teeth of the neighboring crusher rolls may be arranged at staggered angles and be synchronized in terms of their circumferential velocity, if required, so that the distance between the two rolls can be reduced without this causing a contact between the teeth of these rolls.

To achieve the inventive reduction in width of the crusher space, it has turned out to be favorable for the connecting line between the rotation axes of two adjacent crusher rolls within the area of a working gap to run horizontally or slightly inclined at an angle of a accounting for up to 30° versus the horizontal. At the same time, the connecting line in the area of an empty gap may have an angle of β accounting for up to 90° and/or 75°, preferably 30° to 60° versus the horizontal. Large angles β may be particularly advantageous for crusher rolls of different diameters and neighboring each other at an empty gap. On the whole, the angle α should be <angle β. By way of these inclinations of the connecting line according to the present invention, it is possible to ensure the least restricted flow of material in the area of the working gap for various materials while preventing at the same time an undesired hold to the flow of material in the area of an empty gap due to coarse material from above the empty gap. In any case, to reduce the width of the crusher space, it will be attempted to make the angle β as large as possible, independently of the relevant material.

According to the present invention, it is furthermore proposed to arrange two crusher rolls that form an empty gap between them as a construction unit at a tilting table supported in triple-hinged and/or shiftable arrangement at the casing of the multiple roll crusher. This tilting table preferably contains roll beams arranged at the right and left outside the crusher casing, with it being possible to guide the axles and/or shafts of the pertaining crusher rolls through suitable slots of the crusher casing. The two roll beams of a tilting table that belong to a pair of rolls may be jointly slewable around a rotation axis arranged in parallel to the rotation axes of the crusher rolls, wherein the slewability of the tilting table is preferably limited by an adjustable stopper and wherein a preferably pre-tensioned spring acts on the tilting table in the direction of a stopper. By way of this resilient support, it is possible for the crusher rolls of the tilting tables adjacent to the working gap concerned to evade, for example in case of overloading due to excessively hard or non-breakable material, thereby enhancing the working gap for a short term and returning it by the springs into its home position.

The invention is outlined and explained in greater detail by giving some examples based upon the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
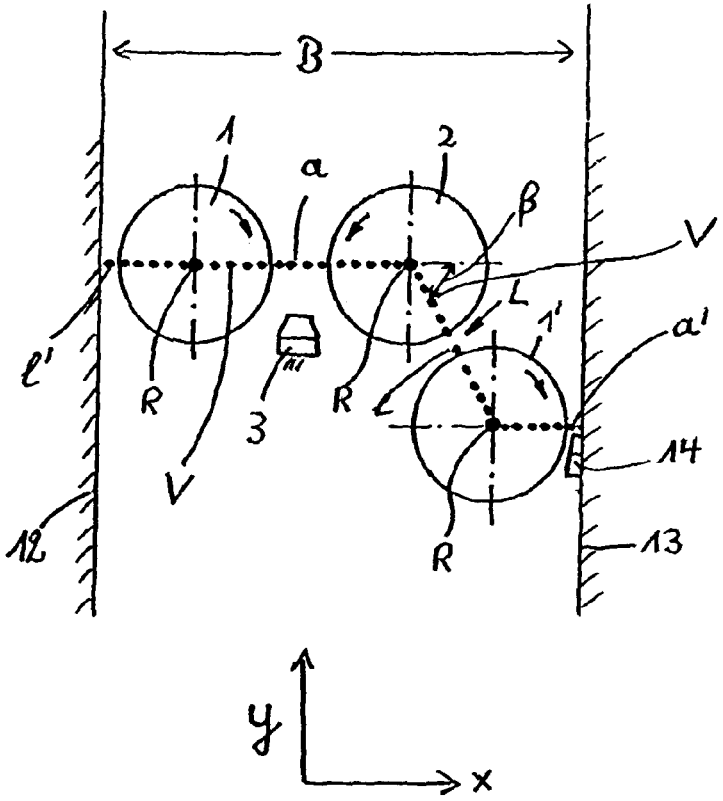
FIG. 1 is a schematic view showing an arrangement of three crusher rolls each in one crusher space.
Figure 2:
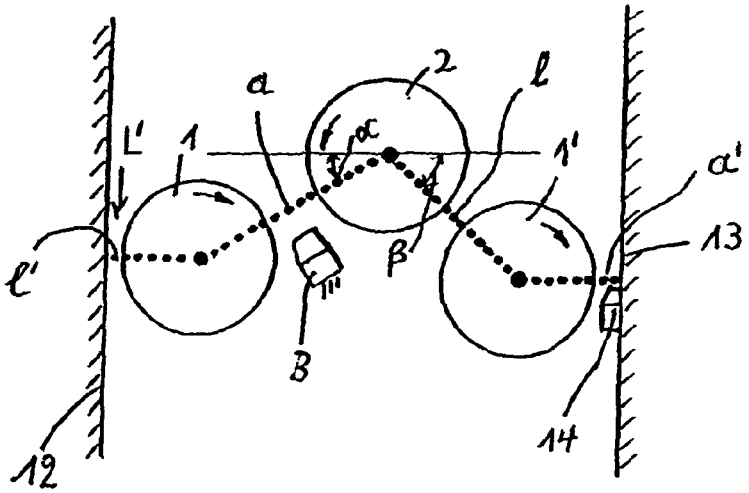
FIG. 2 is a schematic view showing another arrangement of three crusher rolls each in one crusher space.

Referring to the drawings in particular, FIGS. 1 to 4, 6 and 7 show crusher rolls 1, 1', 2, 2' as smooth cylindrical rolls, with it being absolutely possible to have crushing or cutting teeth 4 at the circumference of the rolls as shown in FIGS. 8 to 13. For simplified representation, no crushing or cutting teeth 4 were drawn into FIGS. 1 to 7. The crushing or cutting teeth 4 (shown in FIGS. 8 to 13), however, make sense in particular if there is an anvil ledge 3 extending under the working gaps A, A' each over the entire length of the crusher rolls and/or if there are outer cutting teeth 4. According to FIG. 5, the anvil ledge 3 may be provided with an exchangeable ledge 10 at its upper side, arranging a horizontal continuous cutting ledge 7 at the top and teeth gaps 9 laterally into which the crushing or cutting teeth 4 protrude wholly or partly at the circumference of the crusher rolls 1, 2. According to the representation shown in FIG. 7, the anvil ledge 3 may also have cutting elements 5 at its tip and even cutting elements 6 in the lateral upper area, apart from the cutting ledge 7. The entire anvil ledge is preferably supported vertically or according to its inclination (see FIGS. 2, 6, 12, and 13, for example) in an adjustable arrangement in the direction of material transport and particularly in a resilient arrangement established via springs 8. Outer crushing teeth 14 may be arranged additionally at both walls 12, 13 each, said outer crushing teeth co-operating with the crushing or cutting teeth 4 on the adjacent crusher rolls 1', 2'. These outer crushing teeth 14, too, may be supported in an adjustable and resilient arrangement similar to the one provided for the anvil ledge 3.

Based upon FIG. 1, the simplest embodiment of the inventive multiple roll crusher can be explained and outlined. There, two crusher rolls 1, 2 are arranged at the same level side by side in a flow passage defined by walls 12 and 13. The straight connecting line V shown by a dotted line connects the rotation axes R of the two crusher rolls 1 and 2 as well as the rotation axes R of the crusher roll 2 with the crusher roll 1' which is arranged at a deeper level and in a different plane. Hence, the kink in the connecting line V does exist with the rotation axis R of crusher roll 2. Towards the outside, the connecting line V is prolonged horizontally to the walls 12, 13 each, or transverse to the material transport direction. Located between the two crusher rolls 1, 2 is the working gap A (see FIG. 3) which has the gap width (a) defined in the direction of the connecting line V. Between the marginal crusher rolls 1', 2' and the outer crushing teeth 14, there is the working gap A' each (see FIG. 3) with the gap width a'. The sum of the gap widths (a) and (a') on the overall width B of the crusher space is the decisive measure for the throughput of the multiple roll crusher. Here it matters to obtain the sum of these gap widths (a, a') on the overall width B as large as possible. The second decisive measure are the gap widths I and I' in the area of the empty gap L, L' (see FIGS. 2 and 3) which also extend in the direction of the connecting line V. The empty gap L is defined as the gap between two "inner" crusher rolls 1, 2 or 1, 2' or 2, 1' each, while the empty gap L' is defined as the gap between the marginal crusher rolls 1, 2 and wall 12, 13 where no outer crushing teeth 14 are arranged. In principle the crushing and cutting teeth 4 in the area of the working gap A, A' move downward, or in the material transport direction, so that the material charged above the crusher rolls is moved from top to bottom through working gap A, A'. In the area of an empty gap L, L', the crushing and cutting teeth move upward so that major material coming from above is usually held-up and/or transported to the next working gap A, A'. The gap width I, I' in the area of an empty gap L, L' can be chosen so small that the crushing or cutting teeth 4 can be moved past each other at the least possible distance. In any case, the gap widths I, I' are smaller than or equal to the gap widths a, a'. Depending on the material to be handled, the gap width I, I' may have a certain minimum size, so that fine grain to be handled may also trickle down unrestrictedly through the empty gap L, L'.

According to the invention it matters to arrange the crusher rolls staggered to each other in vertical direction and to shift them together in horizontal direction to achieve the smallest possible overall width B, complying with the required gap widths a, a', I, I' and minimizing the deflection of the material flow in the crusher space. As becomes readily evident from these figures, the width required in horizontal direction in the crusher space diminishes substantially with each inclined arrangement of the connecting line V versus the horizontal. In accordance with the direction of feeding the material above the crusher rolls to the relevant working gap A, A', it has become evident that the angle a may account for up to 30° versus the horizontal, while the angle β may account for up to 90° and/or 75°, and preferably lie between 30° and 60°.

Apart from the preferred embodiments illustrated in these figures, in principle there are other possibilities for a staggered arrangement of the crusher rolls 1, 2, 1',2'. In accordance with FIG. 1, the crusher roll 1' could also be arranged above the other two crusher rolls 1 and 2. Moreover or instead thereof, a crusher roll 2' could also co-act at the wall 12 above or below the two crusher rolls 1, 2 with the outer crushing teeth 14. Even according to the arrangement of FIG. 2, the crusher roll 2 in the middle could for example lie in a lower position between the two crusher rolls 1, 1'.

Figure 3:
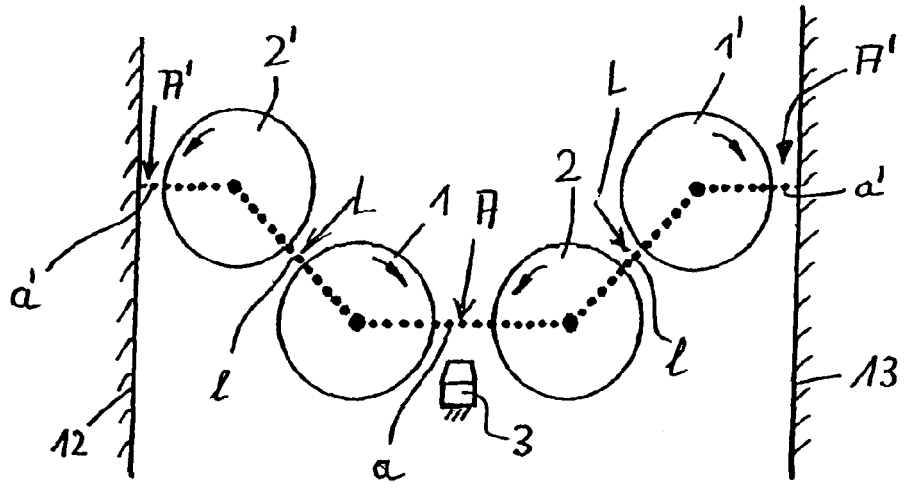
FIG. 3 is a schematic view showing an arrangement of four crusher rolls each in one crusher space.
Figure 4:
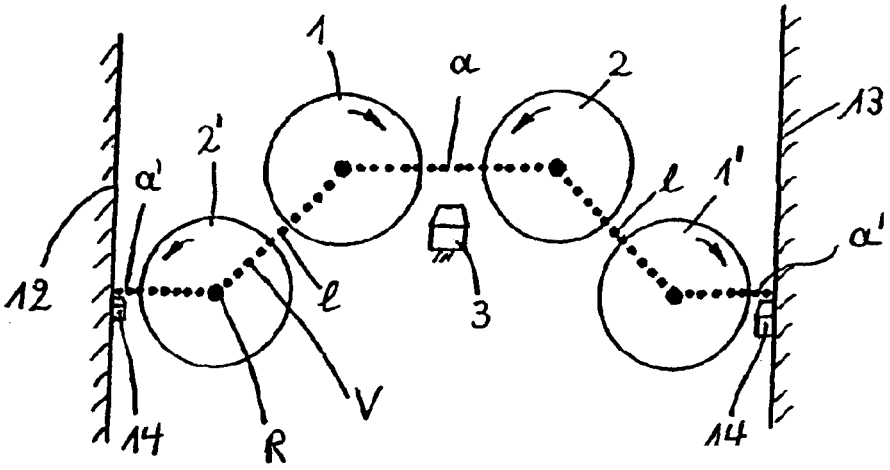
FIG. 4 is a schematic view showing another arrangement of four crusher rolls each in one crusher space.
Figure 5:
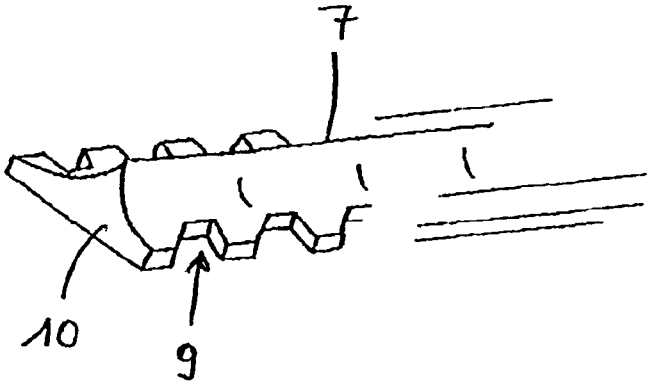
FIG. 5 is a partly cutaway perspective view of a ledge with a cutting ledge.
Figure 6:
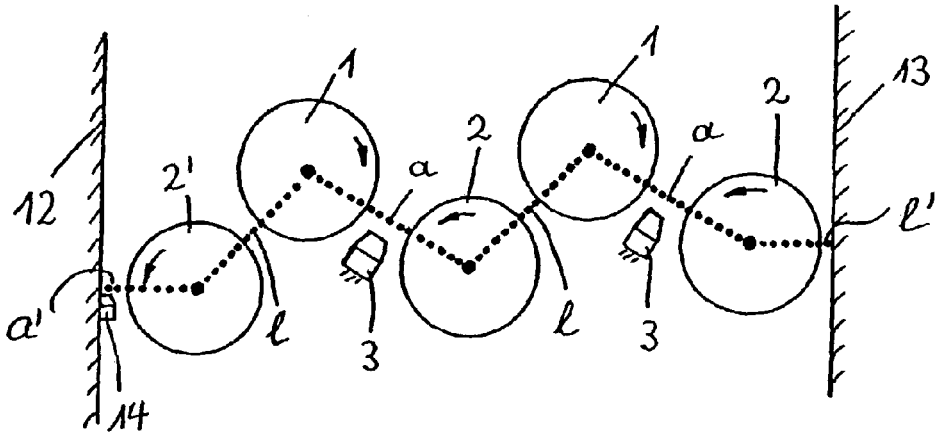
FIG. 6 is a schematic view showing an arrangement of five crusher rolls in one crusher space.
Figure 7:
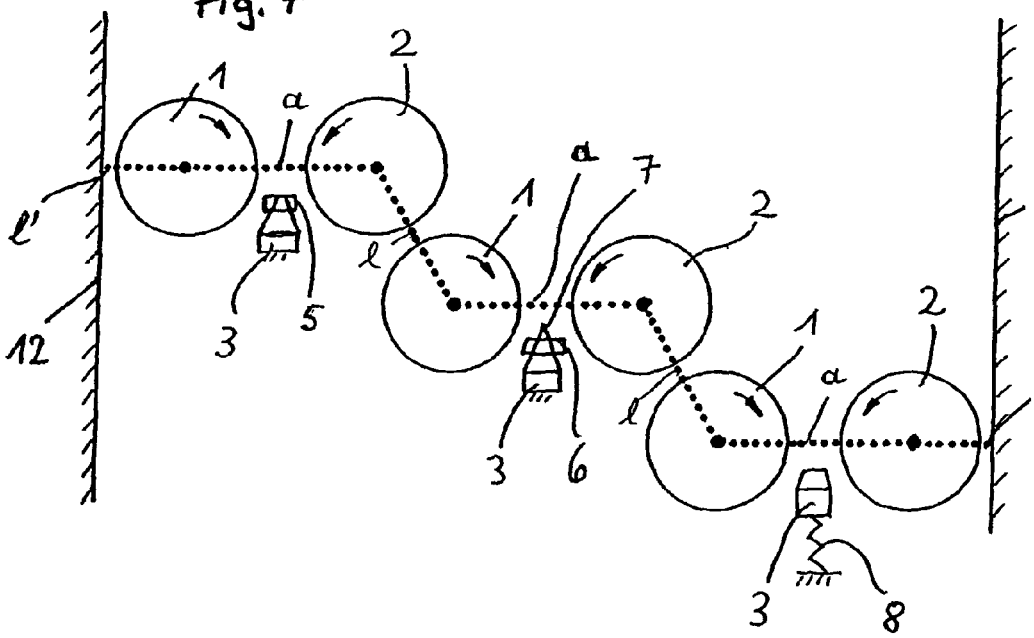
FIG. 7 is a schematic view showing an arrangement of six crusher rolls in one crusher space.
Figure 8:
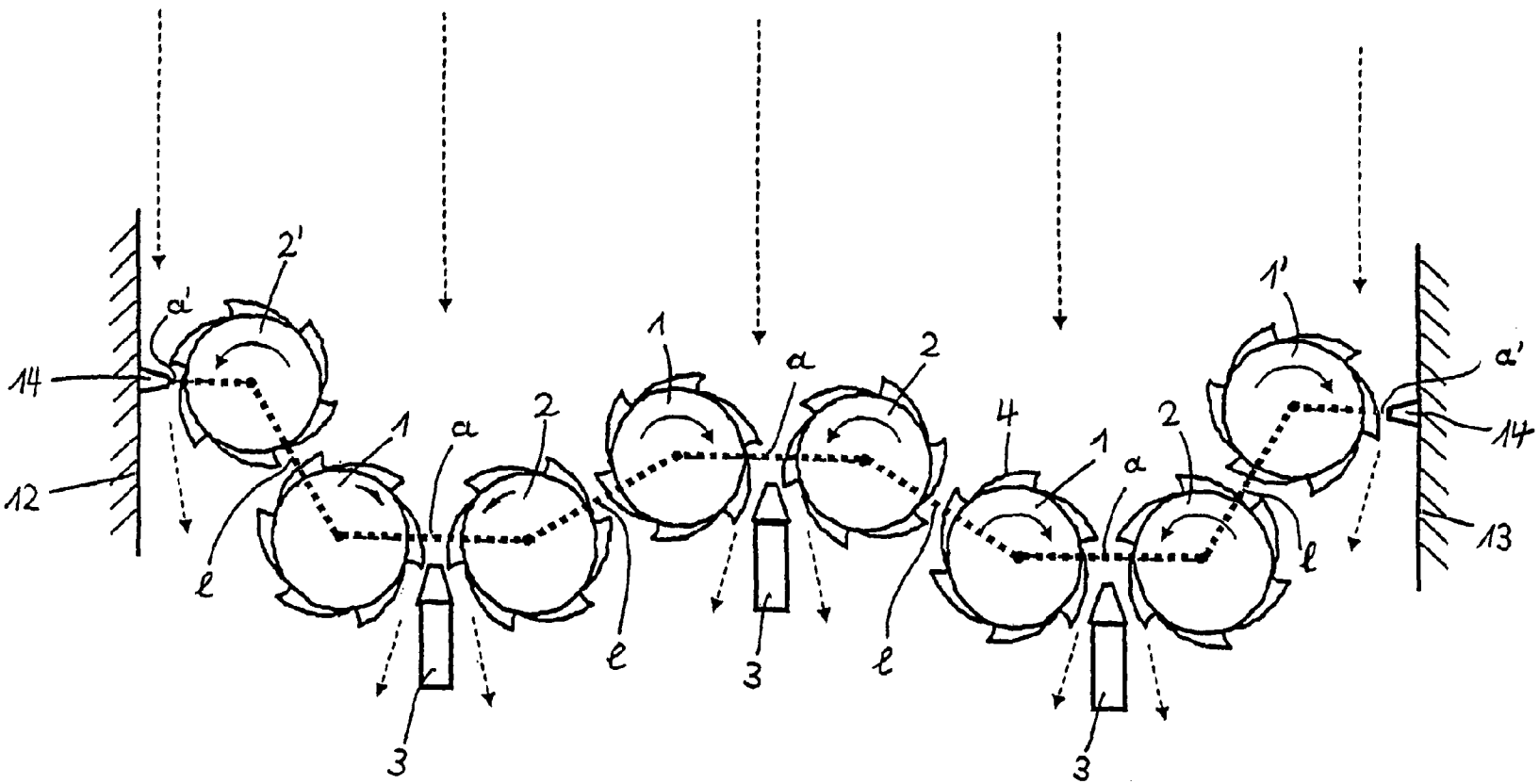
FIG. 8 is a schematic view showing an arrangement of eight crusher rolls each in one crusher space.
Figure 9:
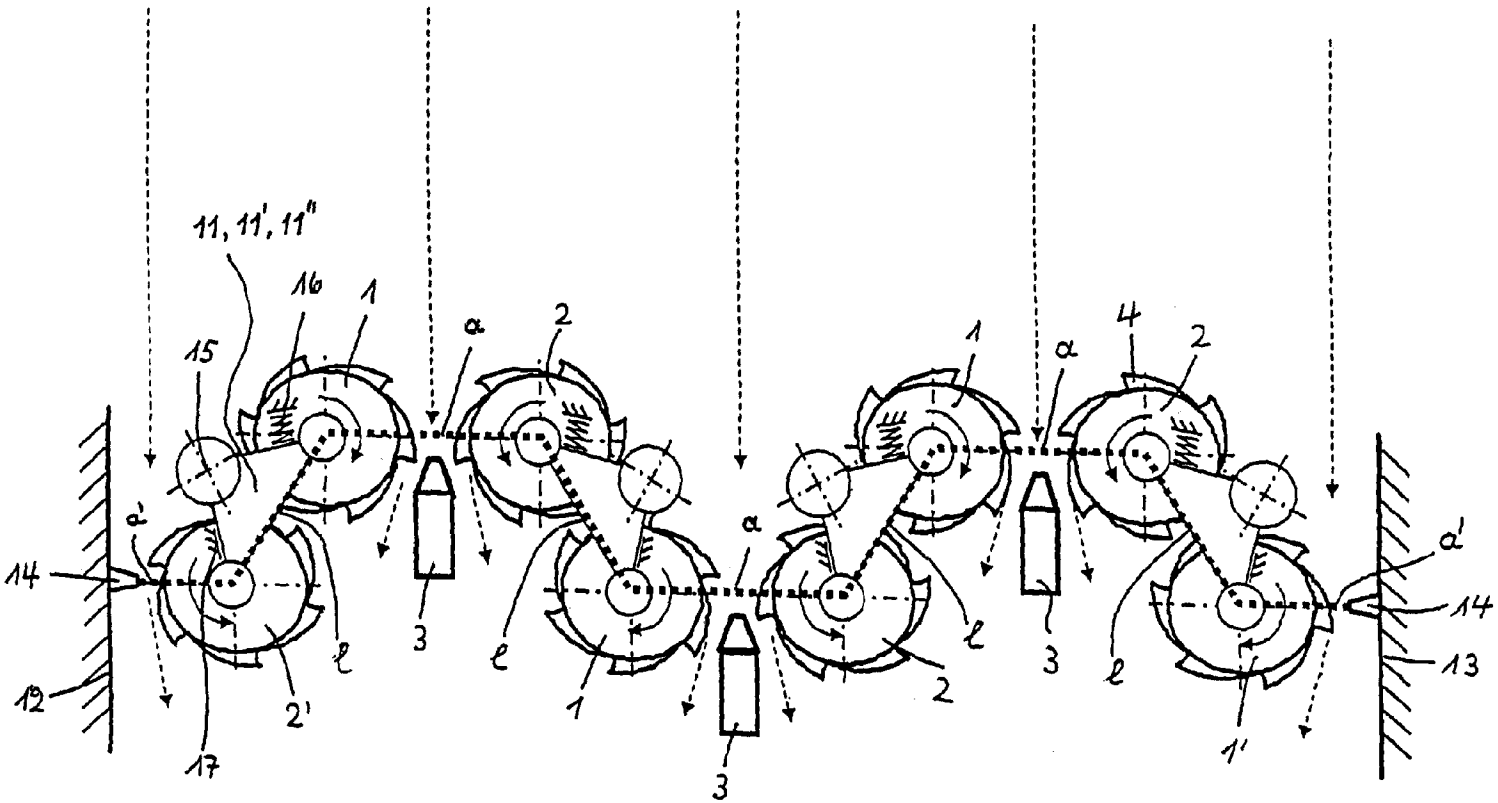
FIG. 9 is a schematic view showing another arrangement of eight crusher rolls each in one crusher space.
Figure 10:
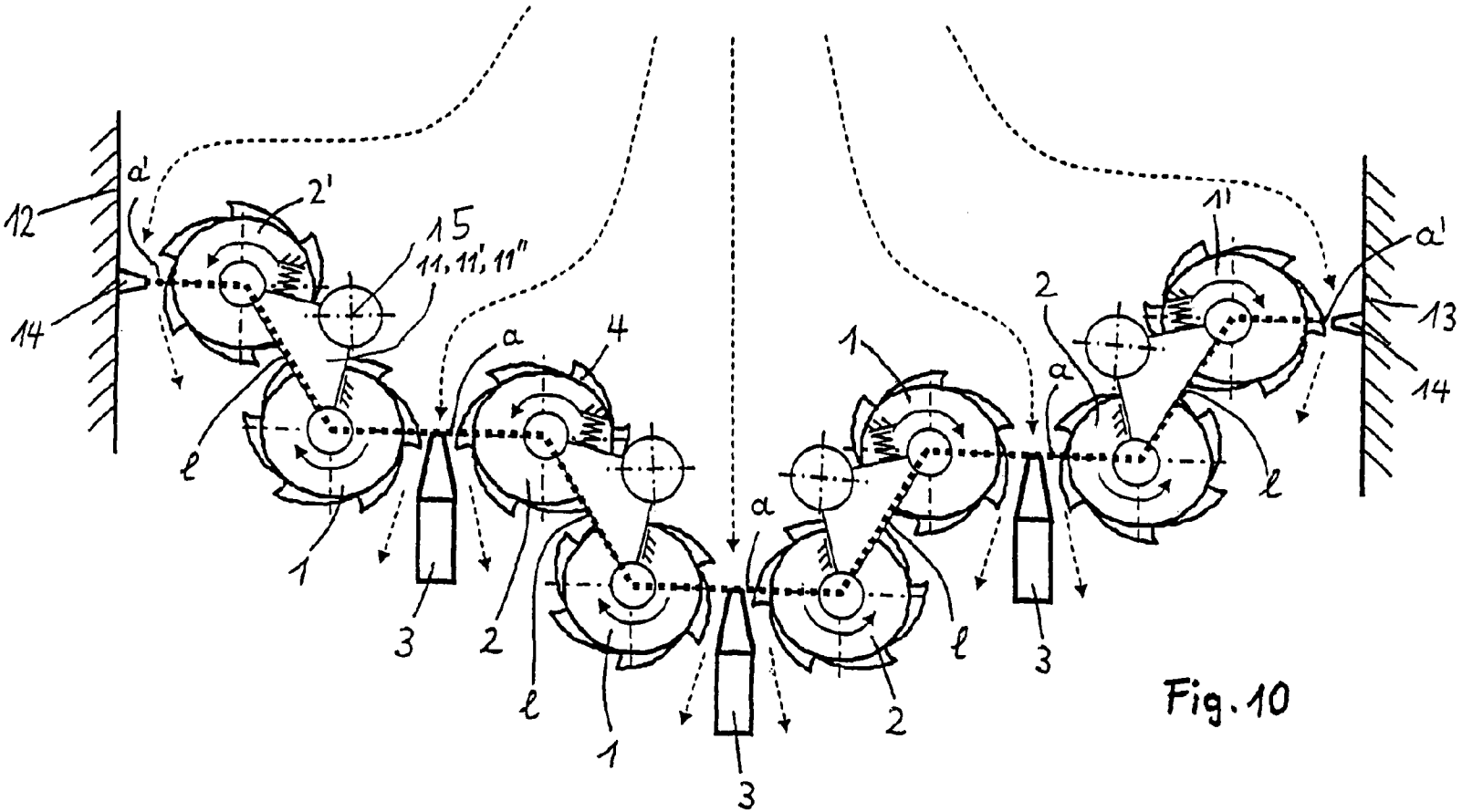
FIG. 10 is a schematic view showing another arrangement of eight crusher rolls each in one crusher space.
Figure 11:
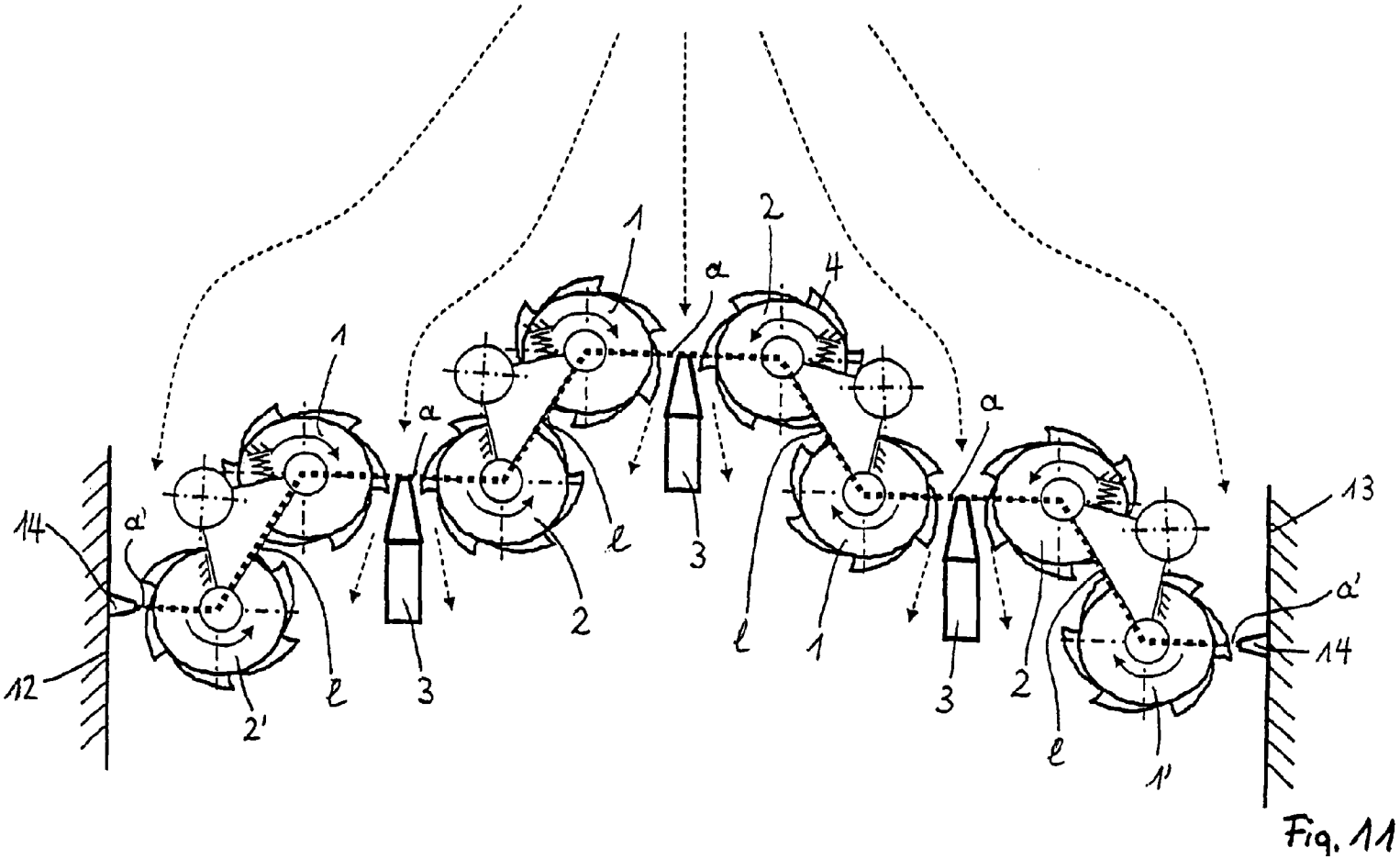
FIG. 11 is a schematic view showing another arrangement of eight crusher rolls each in one crusher space.
Figure 12:
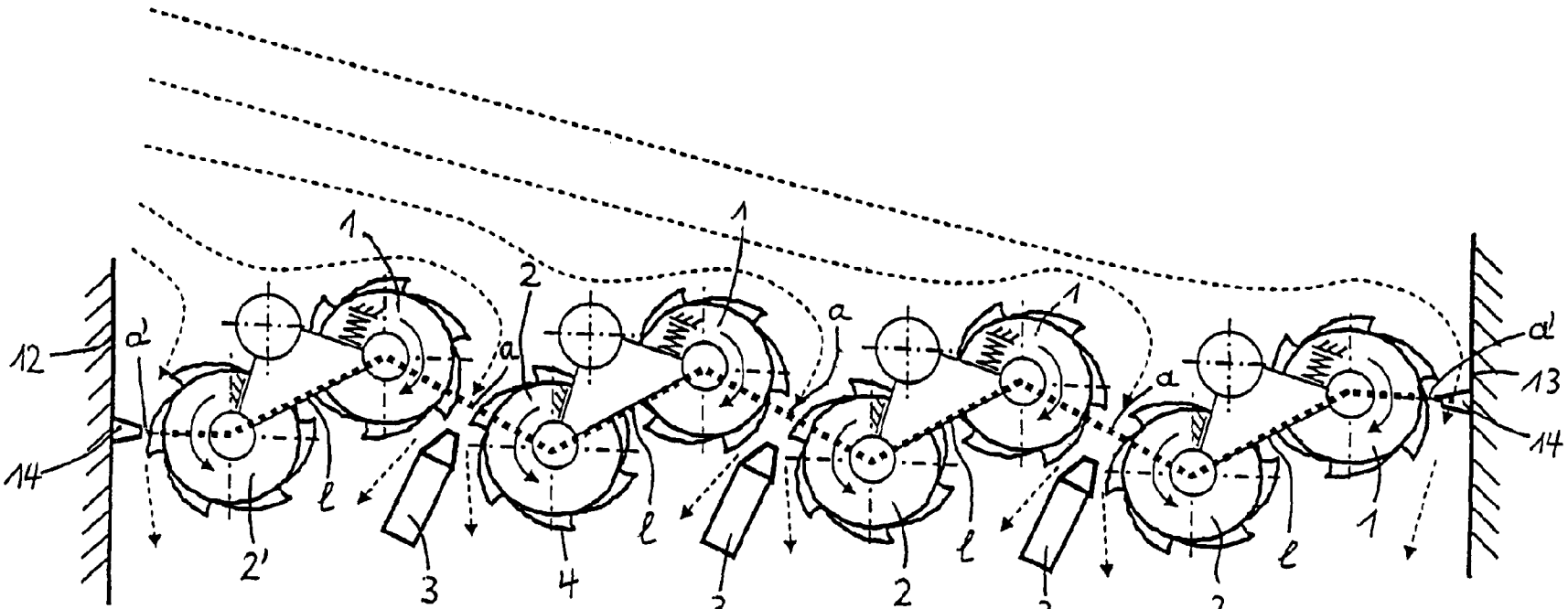
FIG. 12 is a schematic view showing another arrangement of eight crusher rolls each in one crusher space.
Figure 13:
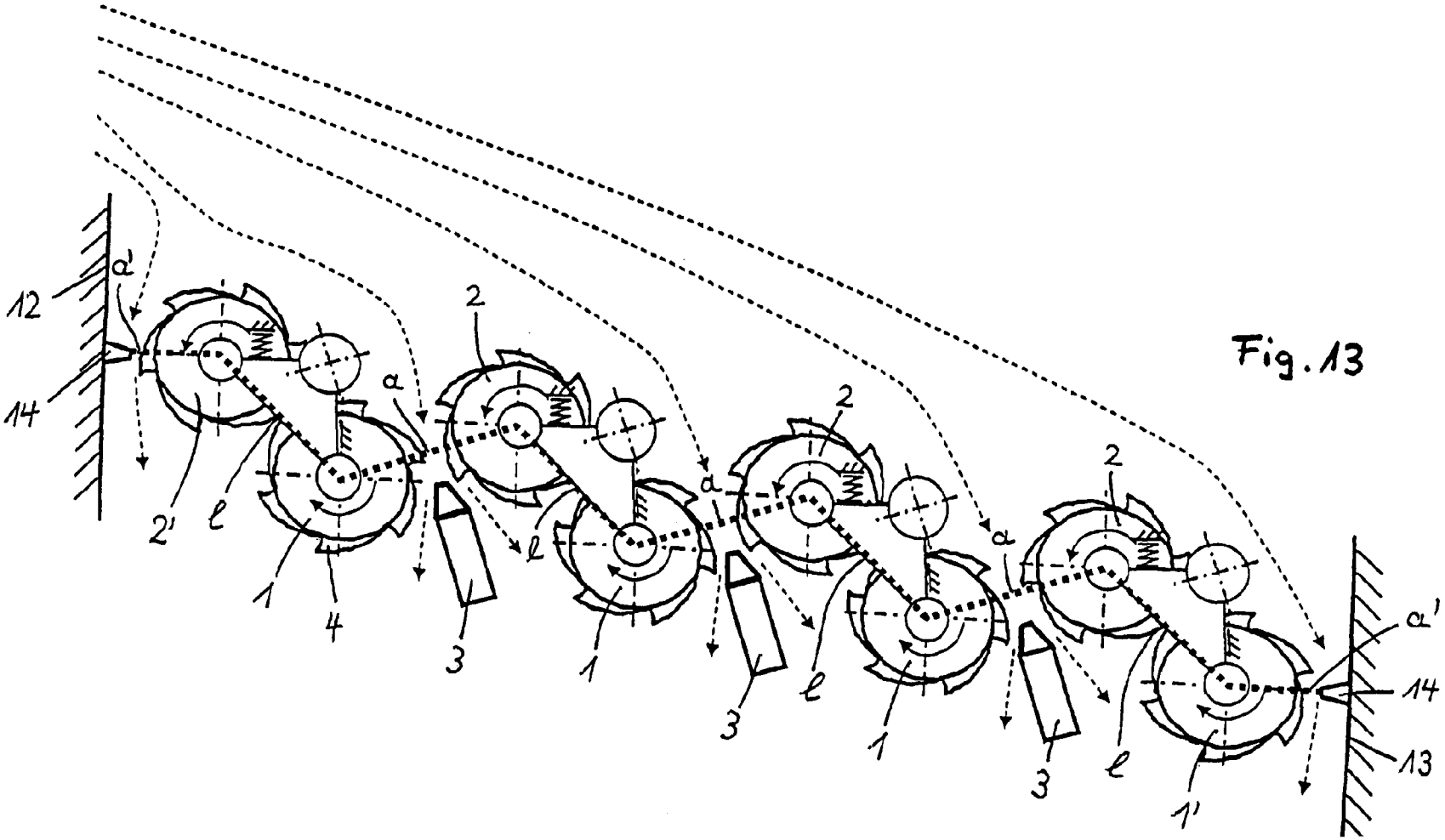
FIG. 13 is a schematic view showing another arrangement of eight crusher rolls each in one crusher space.

FIGS. 3 and 4 show preferred embodiments with four crusher rolls 1, 2, 1', 2' each, because a working gap A and two working gaps A' do exist there in total. In FIG. 4, side walls 12, 13 carry outer crushing teeth 14 that do not exist in FIG. 3. In continuation of the inventive idea, the multiple roll crusher according to FIG. 6 has five crusher rolls 1, 2, 2' with two working gaps A and a marginal working gap A'. With this zig-zag arrangement, the material above the five crusher rolls can spread itself relatively evenly. The cascade or step-like arrangement of the six rolls according to FIG. 7, in particular, offers the possibility of an even distribution to the three working gaps A with a slightly lateral feed, while processing at walls 12, 13 is dispensed with.

In FIGS. 8 to 13, there are eight crusher rolls each shown in one crusher space, there being three working gaps A in the middle and one additional working gap A' each at walls 12, 13. The direction of feeding the material from above and the further transport after the crushing process is shown in these figures by dashed arrows.

According to FIGS. 9 to 13, two neighboring crusher rolls each which have an empty gap L between them, are grouped together via tilting table 11 to form one construction unit. The tilting table 11 preferably contains roll beams 11, 11' arranged at the right and left outside the casing. The rotation axes R of the pertaining crusher rolls are guided through slots of the casing which are not shown here. In its basic position, the tilting table 11 leans to a preferably adjustable stopper 17 and is pressed against this stopper by a pre-tensioned spring 16. This resilient support of the construction unit bears the advantage that in case of handling too hard or non-breakable material, the tilting table is moved about the rotation axis 15 against the spring 16 so that the two pertaining working gaps A, A' can open themselves automatically at the same time by mainly the same measure. As soon as the obstacle is eliminated, the tilting table 11 is swung back into its home position by means of spring 16.

While specific embodiments of the invention have been shown and described in detail to illustrate the application of the principles of the invention, it will be understood that the invention may be embodied otherwise without departing from such principles.

The invention claimed is:

1. A multi-roll crusher for the size reduction of mineral material to be crushed, multi-roll crusher comprising:

a crushing roller arrangement comprising a multiplicity of crushing rolls each with crushing or cutting teeth arranged on a circumference of respective one of said crushing rolls;

a housing defining walls adjoining said crushing rolls, said multiplicity of crushing rolls being arranged to only crush the material once as the material passes through said housing, said crushing rolls having axes of rotation located parallel to one another and extending horizontally or approximately horizontally, each of said crushing rolls having an opposite direction of rotation from a directly adjacent crushing roll to define one of a working gap, in which directly adjacent crushing rolls rotate in a direction drawing material from above the crushing roller arrangement to below the crushing roller arrangement or to define an idle gap in which directly adjacent crushing rolls rotate in a direction against drawing material from above the crushing roller arrangement to below the crushing roller arrangement, said crushing roller arrangement having a line connecting said axes of rotation with at least one portion connecting axes of rotation of directly adjacent crushing rolls being at a non-zero angle with respect to horizontal and an adjacent line portion connecting axes of rotation of directly adjacent crushing rolls being at a non-zero angle relative to said at least one portion.

2. A multi-roll crusher comprising:

a housing with walls, said walls defining a flow passage, said flow passage having an inlet and outlet, said housing having a material transport direction from said inlet to said outlet;

a group of three or more crushing rollers arranged in said flow passage to define working gaps and empty gaps between each pair of rollers of said group of three or more crushing rollers, said each roller of said group of three or more crushing rollers having a rotation axis substantially parallel to each other, said each of said crushing rollers rotating in a direction opposite to a direction of rotation of adjacent said crushing rollers to form a group of said working gaps which have circumferential velocities at a midpoint of the respective gap, said circumferential velocities of said working gaps being at least partially in said material transport direction, said each of said crushing rollers also rotating to form a group of said empty gaps which have circumferential velocities at a midpoint of the respective gap, said circumferential velocities of said empty gaps being at least partially in a direction opposite to said material transport direction, said group of three or more crushing rollers being arranged across said flow passage to have material passing from said inlet to said outlet only pass once through said gaps, one of said crushing rollers being arranged out of a plane formed by said rotation axes of two other of said crushing rollers, one of said crushing rollers being arranged to overlap another one of said crushing rollers in said material transport direction.

3. A multi-roll crusher in accordance with claim 2, wherein:

said circumferential velocities of said working gaps have a velocity component in said material transport direction;

said circumferential velocities of said empty gaps have a first velocity component opposite to said material transport direction, and a second velocity component in a direction transverse to said material transport direction.

4. A multi-roll crusher in accordance with claim 2, wherein:

said circumferential velocities of one of said working gaps is oblique to said material transport direction;

said circumferential velocities of one of said empty gaps is oblique to the opposite of said material transport direction.

5. A multi-roll crusher in accordance with claim 2, wherein:

a transverse direction is present in a direction transverse to said material transport direction;

a connecting line connects said rotation axes, said connecting line extending across said working gaps at an angle of up to 30° with respect to said transverse direction, said connecting line extending across said empty gaps at an angle of less than 90° with respect to said transverse direction.

6. A multi-roll crusher in accordance with claim 2, wherein:

said flow passage is shaped downstream of said group of crushing rollers to pass all material, having passed through one of said gaps of said group of crushing rollers, away from said group of crushing rollers.

* * * * *